US008500314B2

(12) United States Patent
Wu

(10) Patent No.: US 8,500,314 B2
(45) Date of Patent: Aug. 6, 2013

(54) COMBINATION OF A BULB HOLDER AND A LOCKING APPARATUS THEREFOR

(75) Inventor: Yulin Wu, Foshan (CN)

(73) Assignee: Guangdong Cosio Lighting Co., Ltd., Foshan (CN)

( * ) Notice: Subject to any disclaimer, the term of this patent is extended or adjusted under 35 U.S.C. 154(b) by 1380 days.

(21) Appl. No.: 12/198,148

(22) Filed: Aug. 26, 2008

(65) Prior Publication Data

US 2009/0244914 A1 Oct. 1, 2009

(30) Foreign Application Priority Data

Apr. 1, 2008 (CN) ..... 2008 2 0045978 U

(51) Int. Cl.
*G05G 5/24* (2006.01)

(52) U.S. Cl.
USPC ..... 362/429; 362/270; 362/288; 362/148; 362/365; 362/368; 74/575

(58) Field of Classification Search
USPC ..... 362/429, 270, 288, 147, 148, 650, 362/254, 364, 365, 368, 430, 372; 248/342, 248/343, 344, 222.11, 222.12, 222.13, 297.31, 248/292.12; 74/527, 533, 575
See application file for complete search history.

(56) References Cited

U.S. PATENT DOCUMENTS

| | | | | |
|---|---|---|---|---|
| 2,452,233 | A * | 10/1948 | Gerard et al. | 335/32 |
| 2,756,945 | A * | 7/1956 | Robboy | 242/381 |
| 5,857,766 | A * | 1/1999 | Sieczkowski | 362/365 |
| 6,247,835 | B1 * | 6/2001 | Taniuchi | 362/524 |
| 6,588,922 | B1 * | 7/2003 | DeCicco | 362/364 |
| 7,530,705 | B2 * | 5/2009 | Czech et al. | 362/147 |
| 7,654,705 | B2 * | 2/2010 | Czech et al. | 362/364 |
| 8,066,413 | B2 * | 11/2011 | Czech et al. | 362/364 |
| 2010/0022339 | A1 * | 1/2010 | Barve | 474/111 |

* cited by examiner

*Primary Examiner* — Jong-Suk (James) Lee
*Assistant Examiner* — Leah S Macchiarolo
(74) *Attorney, Agent, or Firm* — Matthias Scholl P.C.; Matthias Scholl

(57) ABSTRACT

Provided is a bulb holder locking apparatus, comprising a fixing mount, a bulb holder, a spring and a ratchet mechanism comprising a ratchet bar having a plurality of ratchets, a pawl and a movable cam having a curve contour; wherein the bulb holder is flexibly connected to the fixing mount; the spring is connected to the fixing mount, so as to force the bulb holder to move downwards; the ratchet bar is connected to the bulb holder; the pawl is connected to the fixing mount and elastically contacted with the ratchet bar; the movable cam is slidingly connected to the ratchet bar and elastically contacted with the pawl; and the curve contour comprises a plurality of crests engaged with the pawls.

8 Claims, 13 Drawing Sheets

COMBINATION OF A BULB HOLDER AND A LOCKING APPARATUS THEREFOR

CROSS-REFERENCE TO RELATED APPLICATIONS

This application claims priority benefits to Chinese Patent Application No. 200820045978.X filed Apr. 1, 2008, the contents of all of the aforementioned specifications are incorporated herein by reference.

BACKGROUND OF THE INVENTION

1. Field of the Invention

This present invention generally relates to a lamp structure, and particularly to a bulb holder locking apparatus.

2. Description of the Related Art

For some lamps, such as ceiling aperture lamp, the bulb is mounted deeply inside the lamp housing and does not appear from the lamp housing or just appear a little from the lamp housing, which brings inconvenience to the replacement of bulb. Whereas, the existing technology has invented a bulb holder locking apparatus, with the following characteristics that each press of the bulb, the bulb holder will automatically shift from two locking positions, including one position for the replacement of bulb and the other position as a working position, in which the bulk is under normal working status. However, this bulb holder locking apparatus has significant disadvantages that the bulb hold can only be locked at one working position, and cannot meet the mounting requirements of different types of bulbs. For example, is there are bulbs of different sizes mounded inside one lamp, the large bulb is usually mounted in a deeper position inside the lamp housing and the smaller bulb is usually mounted in a lighter position inside lamping house. But the existing bulb holder locking apparatus can only lock the bulb holder at one working position, obviously cannot meet their requirements.

SUMMARY OF THE INVENTION

The object of the present invention is to provide a bulb holder locking apparatus with multiple locking positions.

For the convenience of description, in this instruction, including claim, the sliding direction of a bulb along with the bulb holder into the lamp housing is defined as the "upward" direction and the opposite direction is defined as the "downward" direction, both "upward" and "downward" directions are defined as the "vertical" direction and the measurement of the vertical direction is defined as "height".

To achieve the above objectives, in accordance with one embodiment of the invention, provided is a bulb holder locking apparatus, comprising a fixing mount, a bulb holder, a spring and a ratchet mechanism comprising a ratchet bar having a plurality of ratchets, a pawl and a movable cam having a curve contour; wherein the bulb holder is flexibly connected to the fixing mount; the spring is connected to the fixing mount, so as to force the bulb holder to move downwards; the ratchet bar is connected to the bulb holder; the pawl is connected to the fixing mount and elastically contacted with the ratchet bar; the movable cam is slidingly connected to the ratchet bar and elastically contacted with the pawl; and the curve contour comprises a plurality of crests engaged with the pawls.

In a class of this embodiment, the ratchet bar is capable of moving upwards.

In a class of this embodiment, the movable cam is capable of moving up and down with respect to the ratchet bar.

In a class of this embodiment, the pawl is contacted with a bevel edge on one side of the crest and the movable cam moves to a limit position with respect to the ratchet bar as the bulb holder moves upwards under external force.

In a class of this embodiment, the pawl moves to a bevel edge on the other side of the crest along the crest as the bulb holder continues moving upwards.

In a class of this embodiment, the pawl moves to another limit position with respect to the ratchet bar in an opposite direction as the bulb holder moves downwards.

In a class of this embodiment, the pawl passes the crest and the ratchet engaged therewith along the crest as the bulb holder continues moving downwards.

In accordance with another embodiment of the invention, provided is a bulb holder locking apparatus, comprising a fixing mount, a bulb holder, a spring and a ratchet mechanism comprising a ratchet bar having a plurality of ratchets, a pawl and a movable cam having a curve contour; wherein the bulb holder is flexibly connected to the fixing mount; the spring is connected to the fixing mount, so as to force the bulb holder to move downwards; the pawl is connected to the bulb holder and elastically contacted with the ratchet bar; the ratchet bar is connected to the fixing mount; the movable cam is slidingly connected to the ratchet bar and elastically contacted with the pawl; and the curve contour comprises a plurality of crests engaged with the pawls.

In a class of this embodiment, the pawl is capable of moving upwards.

In a class of this embodiment, the movable cam is capable of moving up and down with respect to the ratchet bar.

In a class of this embodiment, the pawl is contacted with a bevel edge on one side of the crest and the movable cam moves to a limit position with respect to the ratchet bar as the bulb holder moves upwards under external force.

In a class of this embodiment, the pawl moves to a bevel edge on the other side of the crest along the crest as the bulb holder continues moving upwards.

In a class of this embodiment, the pawl moves to another limit position with respect to the ratchet bar in an opposite direction as the bulb holder moves downwards.

In a class of this embodiment, the pawl passes the crest and the ratchet engaged therewith along the crest as the bulb holder continues moving downwards.

The basic working principles of the present invention are as follows: There are several ratchets on the ratchet bar, therefore, compared with the pawl, the ratchet bar may be locked in multiple positions of different heights. As either the ratchet bar or the pawl is connected to the bulb holder and the other is connected to the fixing mount, the bulb holder may be locked in working positions of different heights, to meet the installation requirements of different types of bulbs. When any replacement of bulb is required, due to the upward and downward limits of the sliding stroke of the movable cam along the ratchet bar, and the ingenious and matched interposition of ratchet, crest and pawl, just push the bulb with hand upward to drive the bulb holder to slide upward for a proper distance and release the bulb, the bulb holder will slide downward under the acting force of spring to the lowest position, where the bulb appears obvious from the lamp housing, for the convenience of replacement of bulb. After the completion of replacement of bulb, just push the bulb with hand upward again, to drive the bulb holder to slide to the original height or slide to a new and proper height according to the requirement of the type of bulb replaced and release, the pawl and ratchet will be engaged again and the bulb holder will be locked in the original working position or a new locking position.

The advantage of the present invention is to provide multiple positions for the mounting of bulb, flexible and convenient.

DETAILED DESCRIPTION OF THE INVENTION

Reference is made to the accompanying drawings in which is shown an illustrative embodiment of the invention from which its features and advantages will be apparent.

Preferred Embodiment 1

Figure 1:
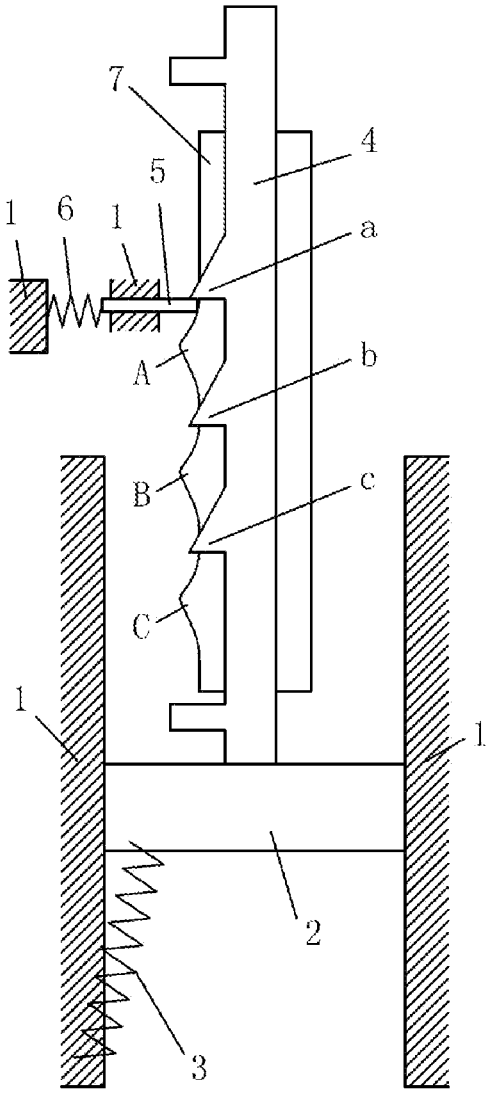
FIG. 1 is a brief view of preferred embodiment 1 of the present invention.
Figure 2:
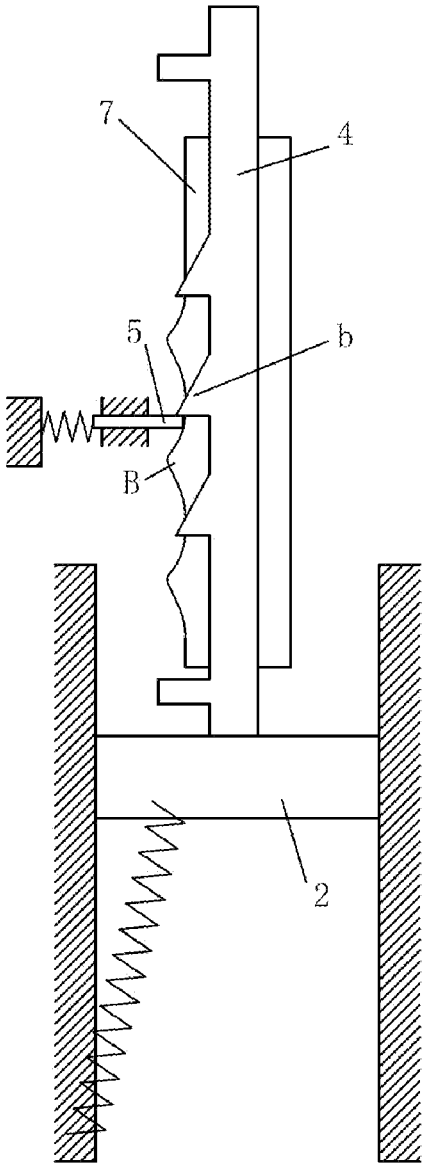
FIG. 2 to FIG. 3 are brief views of the ratchet bar shown in FIG. 1 locked in two positions of different heights.
Figure 3:
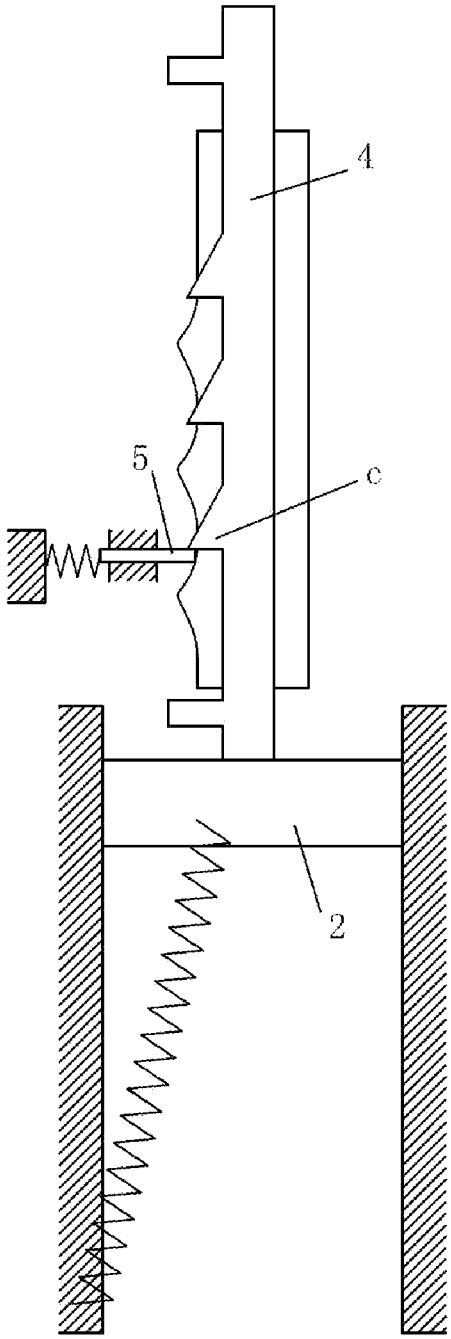

As shown in FIG. 1, the bulb holder locking apparatus comprises a fixing mount 1, a bulb holder 2 connected to the fixing mount 1, a spring 3 disposed on the fixing mount 1 and operating to force the bulb holder 2 to slide downward and a ratchet mechanism, The ratchet mechanism comprises a ratchet bar 4 connected to the bulb holder 2 and comprising multiple ratchets a, b and c, a pawl 5 engaged with the ratchet bar 4 and fixed to the fixing mount 1 and another spring 6 connected between the pawl 5 and the fixing mount 1 and operating to enable the pawl 5 to be elastically contacted with the ratchet bar 4. Under the engagement effect of the pawl 5 and the ratchet, the ratchet bar 4 moves upward only. As there are several ratchets on the ratchet bar 4, the ratchet bar 4 may be locked at positions of different heights by the pawl 5, as shown in FIG. 1 to FIG. 3, and the bulb holder 2 may correspondently locked at three positions of different heights. If it is required to lock bulb holder 2 at more working positions of different heights, just increase the number of ratchets. The minimum number of ratchets may be two and the bulb holder 2 may correspondently locked at two positions of different heights. A movable cam 7 is provided to the sliding connection of the ratchet bar 4 and moves relatively upward and downward along the ratchet bar 4. Under the effect of the spring 6, the pawl 5 is in resilient contact with the ratchet bar 4 as a driven part of the movable cam 7. The curve contour of the movable cam 7 has crests corresponding to the matched ratchets, respectively, crest A and ratchet a match, crest B and ratchet b match, and crest C and ratchet c match.

Figure 4:
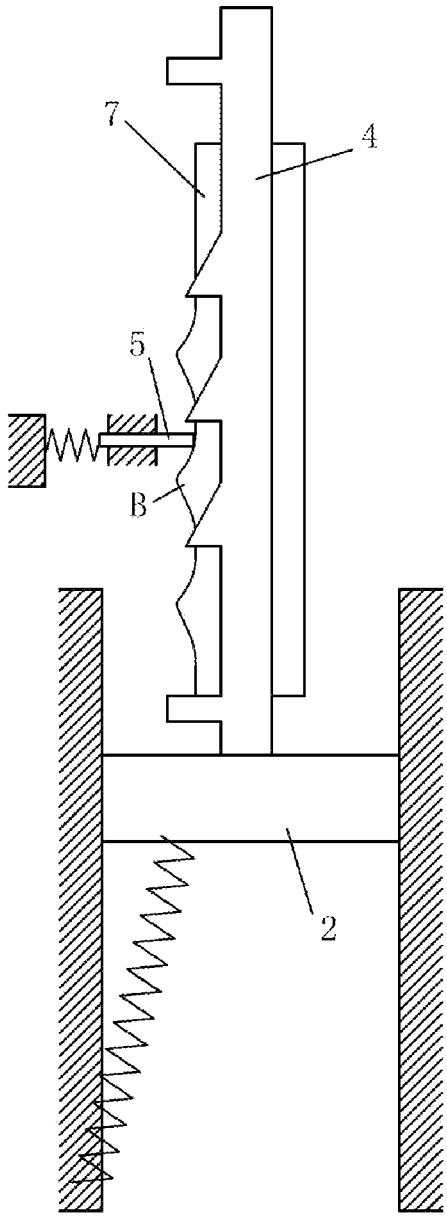
FIG. 4 to FIG. 7 are exploded views of the ratchet bar from the change of locking condition to the release of locking condition.
Figure 5:
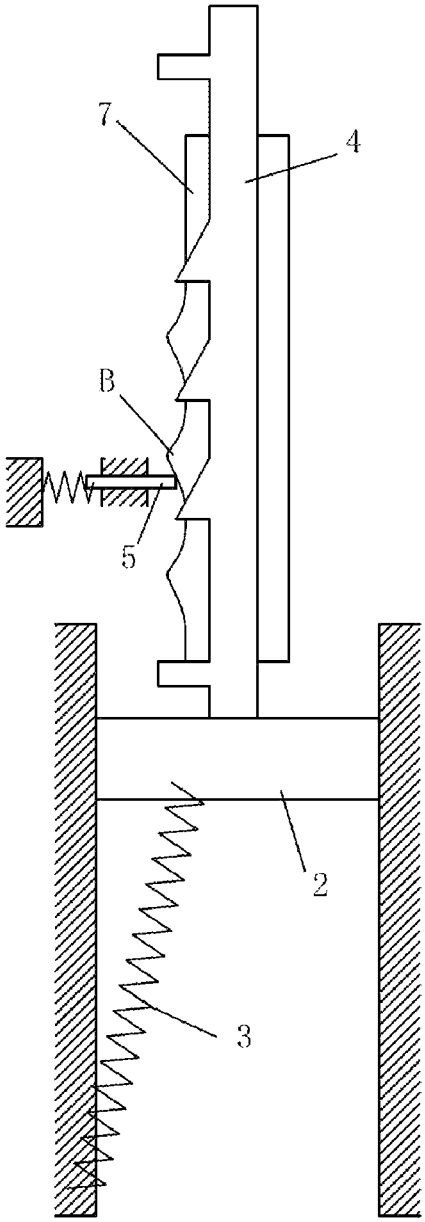
Figure 6:
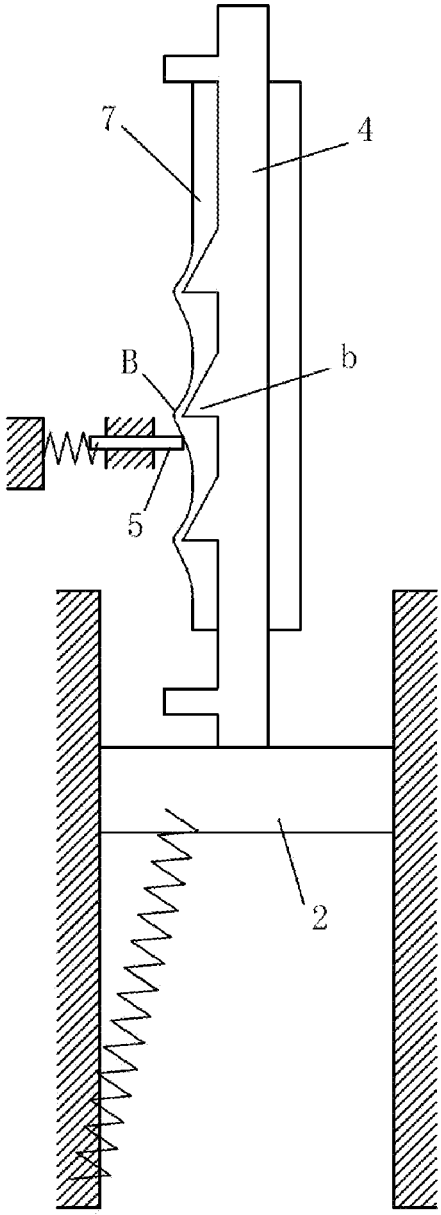

Both sides of each crest are bevel edges, to allow the movable cam 7 to slide upward or downward smoothly along the curve contour of crests. The above-mentioned "bevel edge" may be either straight line or curve. The sliding of the movable cam 7 upward or downward against the ratchet bar 4 to the limits of the stroke, and the interposition of the ratchet, the crests and the pawl meet the following conditions: as for each matched ratchet and crest, such as crest B and ratchet b shown in the figures, from the engagement condition of the pawl 5 and the ratchet b, when the bulb holder 2 is slid upward by external force, the ratchet bar 4 slides upward with the bulb holder 2. As the upper bevel edge of crest B is held up by pawl 5, the movable cam 7 is slid downward against the ratchet bar 4 to the limit, as shown in FIG. 4. From FIG. 4, if the bulb holder 2 moves upward continuously, the movable cam 7 and the ratchet bar 4 as an integral part will move upward together, to drive the pawl 5 to slide to the lower bevel edge of crest B along the curve of crest B, as shown in FIG. 5. From FIG. 5, if the bulb holder 2 is moved downward, the ratchet 4 will moves downward together with the bulb holder 2. As the lower bevel edge of crest B is held up by pawl 5, the movable cam 7 will not slide downward with the ratchet bar 4, on the contrary, it will slide upward against the ratchet bar 4 to the limit, as shown in FIG. 6. From FIG. 6, as the pawl 5 has not engaged with ratchet b, if the bulb holder 2 moves downward continuously, the movable cam 7 and the ratchet bar 4 as an integral part will move downward together, to drive the pawl 5 to slide over crest B and ratchet b along the curve of crest B, as shown in FIG. 7.

Figure 7:
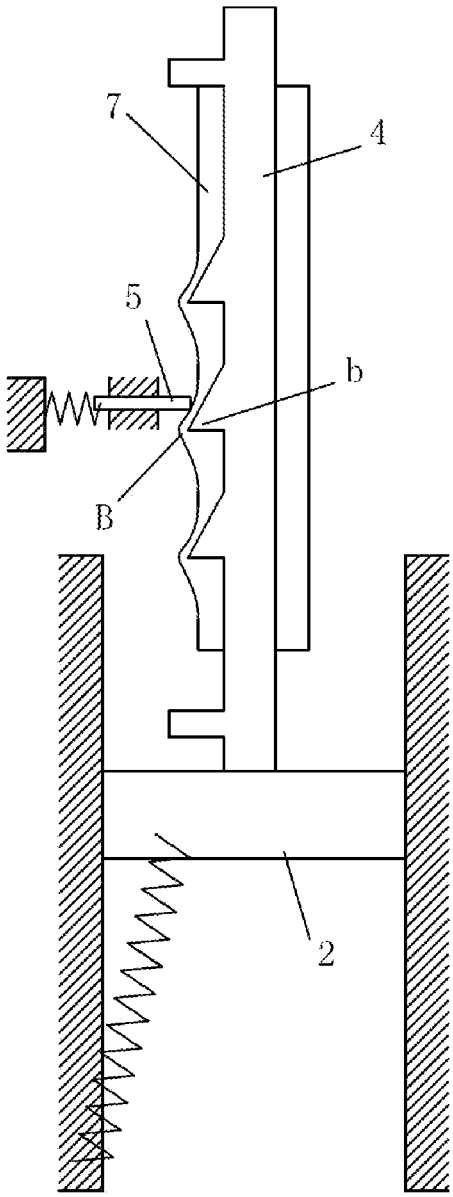
Figure 8:
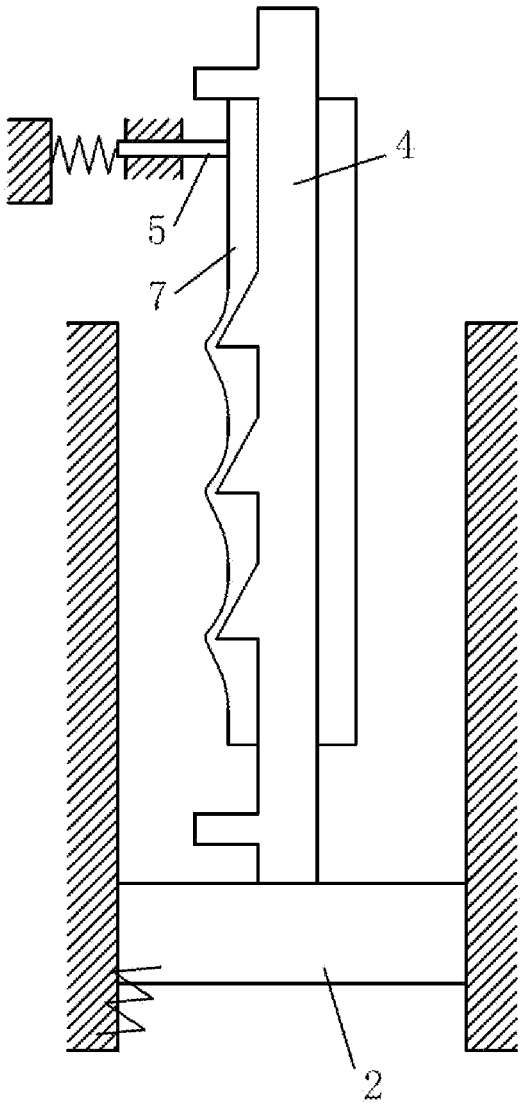
FIG. 8 is a brief view of bulb holder from sliding downward to the lowest position after FIG. 7.

The movement process from FIG. 4 to FIG. 7 is the whole process of ratchet bar 4 from locking condition (FIG. 2) to unlocking condition (FIG. 7), which is also the operation process for the replacement of bulb. As shown in FIG. 2, bulb holder 2 is locked at a working position. To replace a bulb, push the bulb upward with hand, to change the interrelation of ratchet bar 4, pawl 5 and movable cam 7 to the condition shown in FIG. 5. Then release the bulb, the bulb holder will slide downward due to the effect of spring 3, to change the interrelation of ratchet bar 4, pawl 5 and movable cam 7 to the condition shown in FIG. 7. From FIG. 7, the ratchet bar 4 is free from the restriction of pawl 5 and moves downward together with bulb holder 2 to the lowest limit, as shown in FIG. 8. From FIG. 7 to FIG. 8, although the movable cam 7 moves downward with the ratchet bar 4, as the movable cam 7 is held up by pawl 5 all the way and the movable cam 7 is under the upward friction force of the pawl 5, the movable cam 7 maintains an upward sliding condition against the ratchet bar 4 until it reaches the limit, i.e. the mutual relationship between ratchet bar 4 and movable cam 7 is as shown in FIG. 7, to drive the pawl 5 to move upward and pass all ratchets, finally as shown in FIG. 8. When the bulb holder 2 slides downward to the lowest limit as shown in FIG. 8, the bulb (not shown in the figure) appears obviously out of the lamp housing, for the convenience of replacement of bulb.

Figure 9:
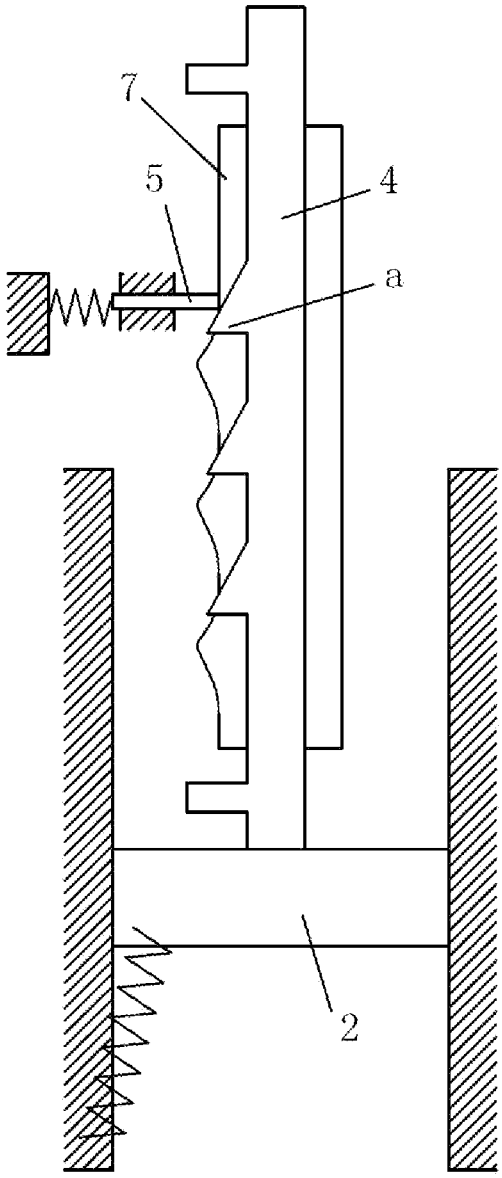
FIG. 9 to FIG. 11 are exploded views of the ratchet bar from the release of locking condition to the resume of locking condition.
Figure 10:
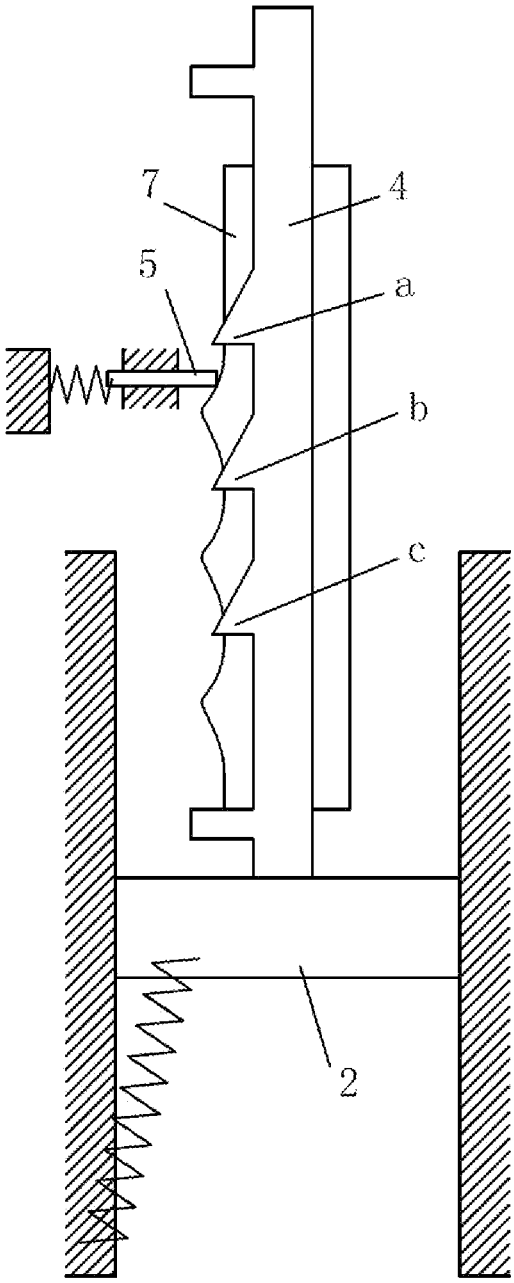
Figure 11:
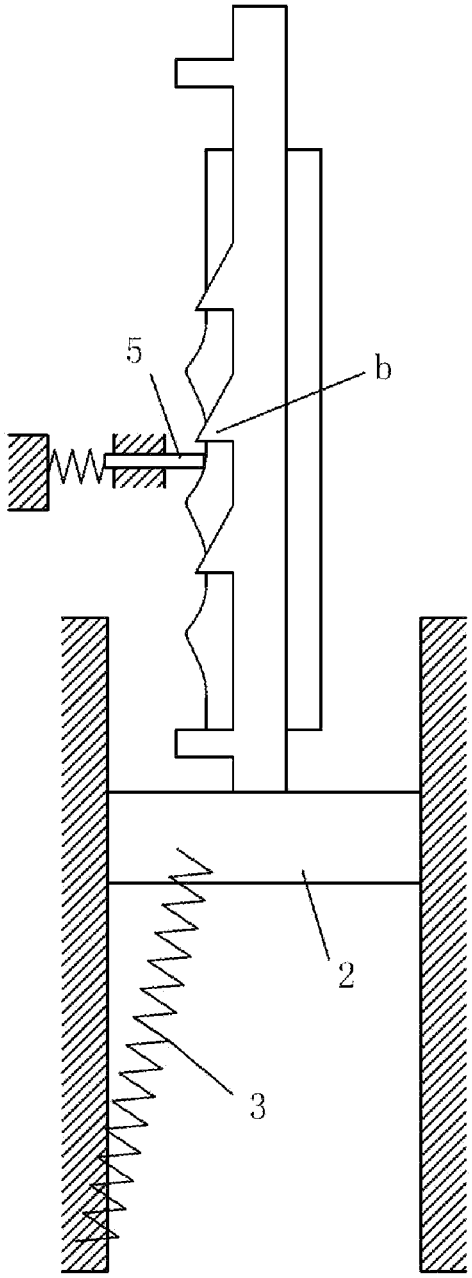

After the replacement of bulb, from the condition as shown in FIG. 8, press the bulb upward with hand again, to drive the ratchet bar 4 to move upward with the bulb holder 2. During the upward movement of ratchet bar 4, the pawl 5 will produce downward friction force to the movable cam 7, to drive the movable cam 7 to slide downward against the ratchet bar 4. When it reaches the status as shown in FIG. 9, the pawl 5 touches the back of the top ratchet a, which is not considered an engagement relationship. As the ratchet bar keeps moving upward, the pawl 5 slides over ratchet a along the back of ratchet a, as shown in FIG. 10. In FIG. 10, as the movable cam 7 has slid downward against the ratchet bar 4 to the limit, the movable cam 7 may move upward together with the ratchet bar 4 as integral part. As the ratchet bar 4 keeps moving upward, the pawl 5 will pass over ratchet b and reach the position as shown in FIG. 11, which is the same position as shown in FIG. 4. If you release the bulb now, the bulb holder 2 will slide downward due to the effect of spring 3, to make the ratchet b be engaged with pawl 5 again, and return to the position as shown in FIG. 2, and the whole process of replacement of bulb is completed.

If it is required to lock the bulb holder 2 at another working position, for example, the working position as shown in FIG. 1, when the bulb holder 2 moves to the position as shown in FIG. 10, release the bulb to lock the ratchet bar 4 and the bulb holder 2 at the position as shown in FIG. 1. Likewise, if it is required to lock the bulb holder 2 at the working position as shown in FIG. 3, when the bulb holder 2 reaches the position shown in FIG. 10, keep pushing the bulb upward until the pawl 5 passes over the lowest ratchet c, then release and lock the ratchet bar 4 and the bulb holder 2 at the position as shown in FIG. 3. If there are more ratchets on the ratchet bar 4, the rest may be inferred, to lock the bulb holder 2 at more working positions.

Figure 12:
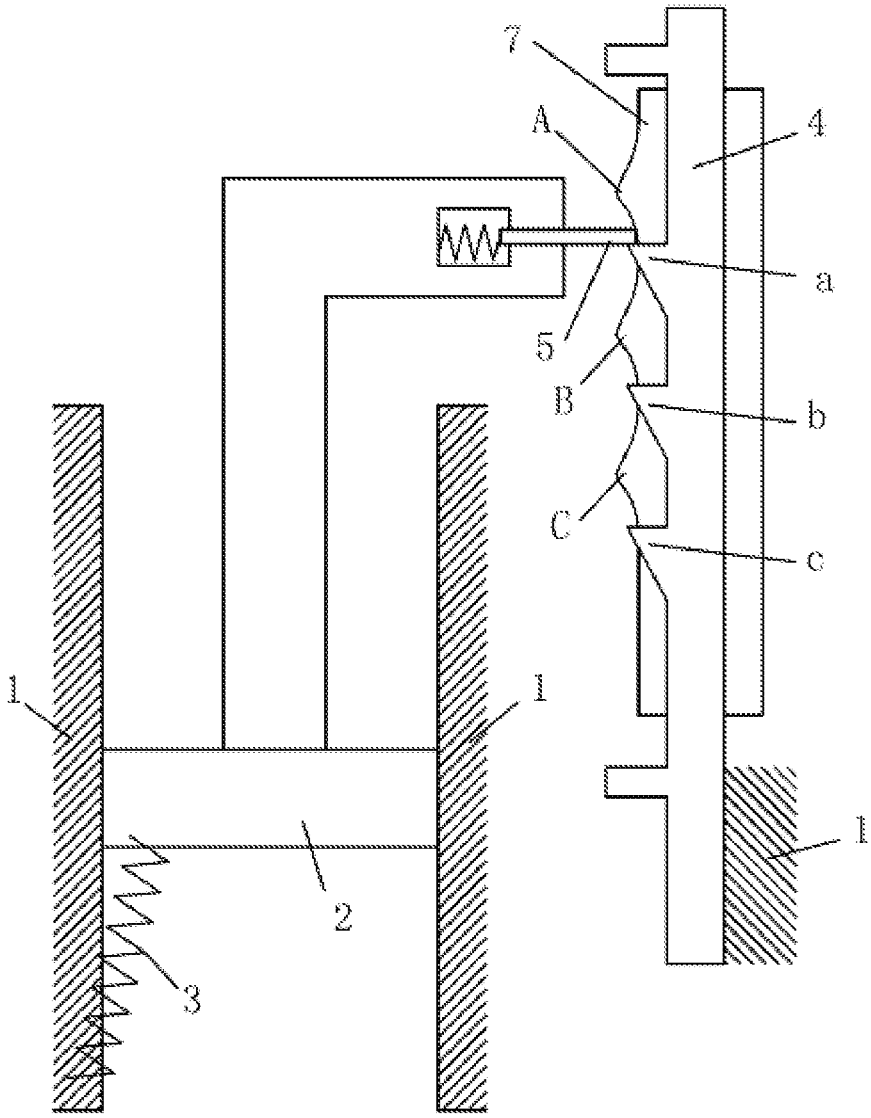
FIG. 12 is a brief view of preferred embodiment 2 of the present invention.

As shown in FIG. 12, the structure of this embodiment is basically the same as embodiment 1, for example, it also comprises a fixing mount 1 connected to the lamp housing, a bulb holder 2 connected to the fixing mount 1, and a ratchet mechanism composed of pawl 5 and ratchet bar 4. A movable cam 7 is resiliently connected to the ratchet bar 4 and pawl 5 is a driven part of the movable cam 7. What is different is that the ratchet bar 4 in this embodiment is fixed and connected to the fixing mount 1, the pawl 5 is connected to the bulb holder 2, and all the directions of ratchets are contrary to those in embodiment 1. Regardless of the said differences, the sliding of the movable cam 7 upward or downward against the ratchet bar 4 to the limits of the stroke, and the interrelationship of ratchet, crest and pawl 5 also meet the conditions specified in the summary of the invention. In FIG. 12, crest A and ratchet a match, crest B and ratchet b match, and crest C and ratchet c match. The working principles of this embodiment are similar to those of embodiment 1 and it is unnecessary to go into details. The main difference is that the ratchet bar 4 in this embodiment is fixed. Under the engagement effect of pawl 5 and ratchet, the pawl 5 moves upward only. When the locking of ratchet bar 4 to the pawl 5 is released, the pawl 5 may move upward and downward with the bulb holder 2.

Preferred Embodiment 3

Figure 13:
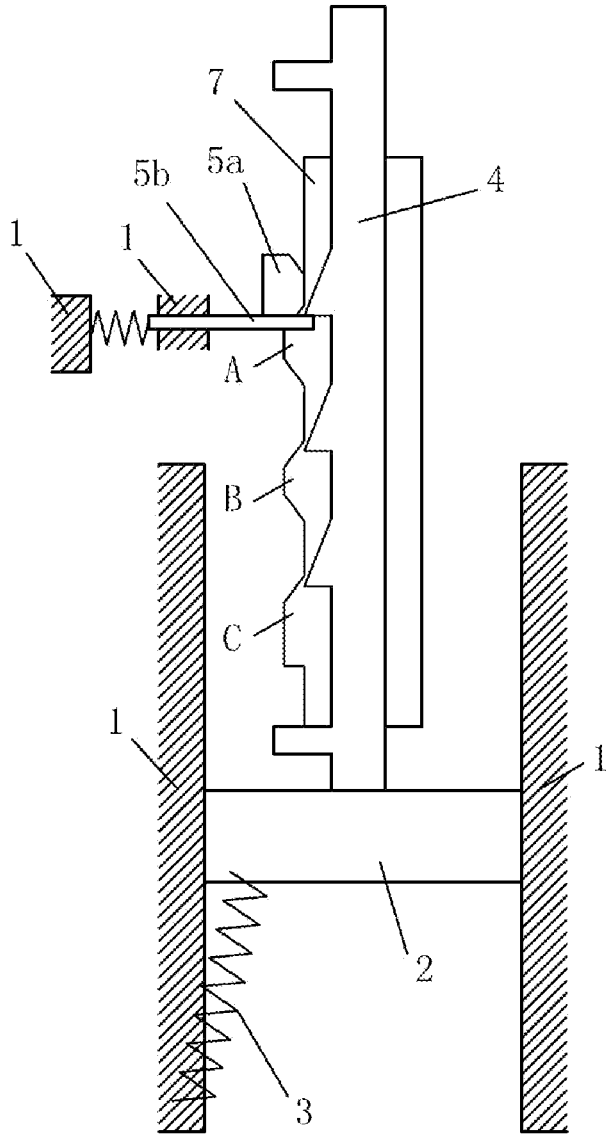
FIG. 13 is a brief view of preferred embodiment 3 of the present invention.

As shown in FIG. 13, the difference between this embodiment and embodiment 1 is the different contour and shape of movable cam and the shape of pawl. The pawl in this embodiment comprises a two parts: the upper part 5*a* is in contact with movable cam 7 and the lower part 5*b* is engaged with the ratchets of the ratchet bar 4. Accordingly, the shapes of crests A, B and C on the movable cam 7 are slightly different from those in embodiment 1. However, the sliding of the movable cam 7 upward or downward against the ratchet bar 4 to the limits of the stroke, and the interrelationship of ratchet, crest and pawl 5 also meet the conditions specified in the summary of the invention. The working principles of this embodiment are the same as those of embodiment 1 and it is unnecessary to go into details.

In addition to the above-mentioned preferred embodiments, the present invention may have other equivalent variations. For example, in embodiment 2, as the ratchet bar 4 is fixed at the fixing mount 1, the movable cam 7 may be resiliently connected to the fixing mount 1, same as sliding connection between the movable cam 7 and the ratchet bar 4; For another example, the pawl 5 may be a spring plate, to leave out the spring 6 in FIG. 1. For another example, the fixing mount may be part of the lamp housing, and so on so on. All equivalent changes and modifications based on the present invention are within the protection scope of the present invention.

What is claimed is:

1. A combination of a bulb holder and a locking apparatus therefor, the locking apparatus comprising:

a fixing mount;

a spring; and a ratchet mechanism comprising a ratchet bar having a plurality of ratchets, a pawl, and a movable cam having a curved contour;

wherein:

said bulb holder is flexibly connected to said fixing mount;

one end of said spring is connected to said fixing mount and the other end of said spring is connected to said bulb holder, so as to force said bulb holder to move downwards;

said ratchet bar is connected to said bulb holder;

said pawl is connected to said fixing mount and elastically contacted with said ratchet bar;

said movable cam is slidingly connected to said ratchet bar and elastically contacted with said pawl; and said curved contour comprises a plurality of crests engaged with said pawl.

2. The combination of claim 1, wherein said ratchet bar is capable of moving upwards.

3. The combination of claim 1, wherein said movable cam is capable of moving up and down with respect to said ratchet bar.

4. The combination of claim 1, wherein said pawl is contacted with a bevel edge on one side of one of said plurality of crests and said movable cam moves to a limit position with respect to said ratchet bar as said bulb holder moves upwards under an external force.

5. The combination of claim 4, wherein said pawl moves to a bevel edge on the other side of said one of said plurality of crests along said one of said plurality of crests as said bulb holder continues moving upwards.

6. The combination of claim 5, wherein said pawl moves to another limit position with respect to said ratchet bar in an opposite direction as said bulb holder moves downwards.

7. The combination of claim 6, wherein said pawl passes said one of said plurality of crests and said ratchet engaged therewith along said one of said plurality of crests as said bulb holder continues moving downwards.

8. A combination of a bulb holder and a locking apparatus therefor, the locking apparatus comprising:

a fixing mount;

a spring; and a ratchet mechanism comprising a ratchet bar having a plurality of ratchets, a pawl, and a movable cam having a curved contour; said curved contour comprising a plurality of crests and each of said plurality of crests comprising a first beveled side and a second beveled side;

wherein:

said bulb holder is flexibly connected to said fixing mount;

one end of said spring is connected to said fixing mount and the other end of said spring is connected to said bulb holder so as to bias said bulb holder away from said pawl;

said ratchet bar is connected to said bulb holder, is elastically contacted with said pawl, and is adapted to move longitudinally with respect to said pawl;

said movable cam is slidingly connected to said ratchet bar, is elastically contacted with said pawl, and is adapted to move longitudinally with respect to said pawl along said plurality of crests;

said pawl is connected to said fixing mount;

when an external force is not applied to said bulb holder, said pawl is engaged with one of said plurality of ratchets and is in contact with said first beveled side, and said ratchet bar is locked with said pawl;

when an external force is applied to said bulb holder in a direction toward said pawl, the external force pushes said bulb holder towards said pawl, said one of said plurality of ratchets is disengaged from said pawl and moves past said pawl, said movable cam longitudinally moves past said pawl along said one of said plurality of crests, said second beveled side comes into contact with said pawl, and said ratchet bar is unlocked from said pawl.

* * * * *